United States Patent [19]

Kaylor

[11] Patent Number: 5,053,147

[45] Date of Patent: Oct. 1, 1991

[54] METHODS AND COMPOSITIONS FOR EXTINGUISHING FIRES

[75] Inventor: Joseph B. Kaylor, Jonesboro, Ga.

[73] Assignee: Jannette Gomez Kaylor, Manassas, Va.

[21] Appl. No.: 511,729

[22] Filed: Apr. 20, 1990

[51] Int. Cl.[5] ..... A62D 1/00

[52] U.S. Cl. ..... 252/7; 252/8.05; 252/307; 106/18; 106/18.15; 169/44; 169/46

[58] Field of Search ..... 252/7, 8.05, 307; 106/18, 18.15; 169/44, 46

[56] References Cited

U.S. PATENT DOCUMENTS

| | | | |
|---|---|---|---|
| 3,179,588 | 4/1965 | Siimes | 252/2 |
| 3,553,127 | 1/1971 | Warnock et al. | 252/5 |
| 3,755,163 | 8/1973 | Broll et al. | 252/7 |
| 3,947,365 | 3/1976 | Cottrell et al. | 252/5 |
| 4,265,806 | 5/1981 | Grundmann et al. | 260/45.8 NT |
| 4,402,364 | 9/1983 | Klein | 169/47 |
| 4,424,133 | 1/1984 | Mulligan | 252/8.05 |
| 4,464,202 | 5/1984 | Mischutin | 428/254 |
| 4,600,606 | 7/1986 | Mischutin | 427/389 |
| 4,606,832 | 8/1986 | Hisamoto et al. | 252/8 |
| 4,720,397 | 1/1988 | O'Mara et al. | 427/180 |
| 4,837,249 | 6/1989 | O'Mara et al. | 523/175 |
| 4,871,477 | 10/1989 | Dimanshteyn | 252/609 |
| 4,904,399 | 2/1990 | Waynick | 252/11 |

FOREIGN PATENT DOCUMENTS 1397793 6/1975 United Kingdom .

*Primary Examiner*—Robert L. Stoll
*Assistant Examiner*—N. Bhat
*Attorney, Agent, or Firm*—Roland H. Shubert

[57] ABSTRACT

Fires, particularly fires of flammable liquids, are extinguished by applying to the burning surface an extinguishing composition containing particles of a thermoplastic polymer, suitably a rubber. The polymer particles are arranged in association with a sufficient quantity of a chemical extinguishing agent to protect the polymer particles during transit through flame to the burning surface. Upon striking the surface of a flammable liquid the polymer dissolves therein causing the liquid to gel and concentrating fire extinguishing agents on the liquid surface thus securing the liquid against reignition.

17 Claims, No Drawings

METHODS AND COMPOSITIONS FOR EXTINGUISHING FIRES

BACKGROUND OF THE INVENTION

1. Field of the Invention

This invention relates generally to the art of extinguishing fires through the use of novel extinguishing agents.

More particularly, this invention relates to the use of combustible high molecular weight thermoplastic polymers as fire control and extinguishing agents.

In one specific embodiment, this invention relates to the use of fire extinguishing compositions containing high molecular weight polymers to suppress and extinguish burning flammable liquids.

2. Description of the Related Art

Combatting fires in flammable liquids (Class B fires) is generally recognized as presenting one of the most difficult challenges in the art of fire fighting. It is conventional to use either dry chemicals or foams in combating such fires. Each of those types of fire extinguishing agents has its own advantages and deficiencies.

Dry chemicals useful in fire fighting include a variety of alkali and alkaline earth metal compounds and other salts, probably the most well known being sodium bicarbonate. The use of sodium bicarbonate as an extinguishing agent goes back at least a century and it is still in common use today. Potassium bicarbonate formulations came into use about 1959 and these agents, which came to be know as "Purple K", have about twice the flame quenching capacity per unit weight as do the analogous sodium bicarbonate formulations. Later, another dry chemical formulation based on potassium chloride was developed and this formulation is known as "Super-K".

Another group of compounds which have found extensive recent use in dry chemical formulations are the ammonium phosphates, particularly monoammonium phosphate (ammonium dihydrogen phosphate). That compound has about the same extinguishing effectiveness toward flammable liquids as does sodium bicarbonate. It breaks down in the heat of the flame to leave a glassy residue or coating comprising metaphosphoric acid. Ammonium polyphosphates have also found use in dry chemical formulations. These compounds are prepared by heating polyphosphoric acid and reacting the heated mixture with ammonia as is described in U.S. Pat. No. 3,755,163. That patent asserts that the polyphosphates are more effective fire extinguishing agents on a weight basis than are the primary or secondary ammonium phosphates.

Probably the most effective dry chemical fire extinguishing agents are those formulations based on a carbamic powder which is an addition product of urea with potassium bicarbonate. Such products are sold under the tradename "Monnex" and are reportedly some twice or more as efficient as potassium bicarbonate for flame extinction. An example of a Monnex formulation is found in U.S. Pat. No. 3,947,365.

All of those dry chemical fire extinguishing agents achieve rapid extinguishment of flames in burning hydrocarbons and other flammable substances but all have a common fault. None have a lasting, or securing effect on the fuel source and so a fire tends to repeatedly reignite or flash back so long as there is an ignition source in contact with flammable vapors. It is postulated in the art that reignition occurs because the powder extinguishment agent is wetted as it contacts the surface of the burning liquid and, because it is more dense than is the liquid, sinks in the liquid. Once the agent is immersed in the liquid, its usefulness as an extinguishing or flame-inhibiting agent is lost.

A flammable liquid can be secured against reignition by use of a foam agent which floats on the surface of the liquid and acts to extinguish flames by isolating fuel vapors from the atmosphere. Such foam agents may comprise, for example, an aqueous blend of a fluorosurfactant and a hydrolysed protein or may be a film-forming foam based on fluorosurfactants known commercially as "AFFF" compositions. Examples of such compositions are shown in U.S. Pat. No. 4,424,133. Foam must be applied to the surface of the burning liquid and allowed to flow over the entire burning area. Foam-type extinguishing agents are generally much slower in operation than are dry chemical agents. Further, the use of foams can be greatly disrupted by air flow or by wind which tends to strip the foam from the liquid surface.

A number of attempts have been made to overcome the deficiencies of both the traditional dry chemical and foam fire extinguishing agents. An anti-reflash dry chemical agent is described in U.S. Pat. No. 3,553,127 to Warnock et al. That patent describes a dry powder fire extinguishing composition comprising a conventional powder base material, such as an alkali metal bicarbonate, which has a fluorocarbon surfactant adsorbed on its surface. The powder particles having a surfactant coating are resistant to wetting by liquid fuels and cause the particles to float on the liquid surface. Those floating particles produce a film or barrier on the liquid surface which tends to retard evaporation of the liquid and inhibits reignition of the unburned fuel portion.

Certain polymeric materials have also been proposed for use in fire extinguishing compositions. The Siimes patent, U.S. Pat. No. 3,179,588, for example, discloses use of a phenolic resin and a silicone resin in combination with an ammonium phosphate, an alkali metal sulfate, mica and magnesium or zinc stearate. The phenolic resin is said to modify the particle form of the powdered phosphate and sulfate metal salts. Phenolic resins satisfactory for use may suitably be a phenol-aldehyde condensation product so long as it is a B-stage reaction product and is in powder form. A B-stage phenolic resin is one that is partially reacted to a stage where it is insoluble in hydrocarbons and common organic solvents but remains plastic during a limited period of heat working. Ordinarily, a B-stage resin is heated and shaped by the user during which the resin is converted to the C-stage. A C-stage phenolic resin is insoluble in essentially all solvents and cannot be melted or softened by reheating. The silicone resin used by Siimes functions to form an external shell on the powder particles to impart water repellency to the particles.

U.S. Pat. No. 4,402,363 to Klein uses polymer "micro-bits" in a water slurry to put out fires. A polymer micro-bit is a foamed plastic such as foamed polystyrene or foamed polyurethane which has been shredded or pulverized to form small particles. Each of those particles absorbs and holds water. According to the patent, the micro-bits adhere or stick to a burning surface. That allows all of the water contained in each micro-bit to be fully utilized in producing steam which both cools the fire surface and tends to exclude oxygen from the flame.

Yet another approach is illustrated by the patent to Hisamoto et al, U.S. Pat. No. 4,606,832. That patent describes a fire extinguishing composition comprising a mixture of Halon (which is the trademark for bromofluorohydrocarbon or bromochlorohydrocarbon extinguishing agents) with a fluorine-containing polymer having a molecular weight in excess of 5,000 and preferably having a molecular weight in excess of 10,000. The composition is stated to be particularly useful in combatting oil or grease fires as the fluorine-containing polymer forms a heat resisting film on the oil surface thereby tending to prevent reignition of the unburned fuel.

In all of those prior art approaches to the extinguishing of burning flammable liquids, the unburned portion of the flammable liquid remains mobile and will reignite if the foam or film covering the surface of the liquid is disrupted. Further, the unburned mobile liquid is free to drain or travel to a new location thus spreading the fire as often occurs with fuel fires aboard ships.

Thus it can be readily appreciated that a fire extinguishing composition which rapidly suppresses the flame of a burning flammable liquid and also substantially decreases the mobility and flammability of the unburned liquid provides important advances in the art of fire fighting.

SUMMARY OF THE INVENTION

Fires are extinguished by applying to the burning area a fire extinguishing composition containing a high molecular weight thermoplastic polymer intimately associated with powdered dry chemical fire extinguishing agents which protect the polymer during its transit through the flame and onto the burning surface. The polymer forms an extinguishing chemical-rich coating on the burning surface or, in the case of burning flammable liquids, may dissolve in the liquid to gel and inhibit the mobility of the liquid while rendering exposed surfaces non-flammable.

Hence, it is an object of this invention to provide new fire extinguishing compositions which contain as a necessary component a combustible, high molecular weight, thermoplastic polymer.

Another object of this invention is to provide methods for the extinguishing of fires and to prevent reignition of exposed surfaces.

A specific object of this invention is to provide compositions and methods for the extinguishing of fires of flammable liquids; to gel those liquids sufficiently to inhibit liquid flow; and to prevent reignition of exposed surfaces.

Other objects of this invention will be apparent from the following description of preferred embodiments and exemplary uses.

DESCRIPTION AND DISCUSSION OF THE INVENTION

This invention includes methods and compositions useful generally in the extinguishing of fires and provides particular advantage in the extinguishing of fires of flammable liquids. The fire extinguishing compositions of this invention may be formulated and applied either as a dry, free-flowing powder or as a foam.

Turning first to the powder embodiment of the present invention, the composition comprises small particles of a high molecular weight thermoplastic polymer intimately associated with and protected be dry chemical fire extinguishing agents. The dry chemical agents perform a number of functions. First, those agents act in conventional fashion to quench flames. The agents also serve to protect the polymer particles so that the polymer particles are not consumed during their transit through the flames but instead the particles survive to reach the surface of the burning area. If the burning material is a solid, the polymer melts onto the surface thereof forming a coating which contains a high concentration of dry chemical extinguishing agents. That coating then tends to effectively prevent reignition of the flammable material.

Certain compositions of this invention provide particular advantages when used to extinguish fires of flammable liquids. In this embodiment, the thermoplastic polymer is selected to be soluble in the flammable liquid. For example, if the flammable liquid is a fuel such as gasoline, jet fuel, lubricating oil, crude oil and the like, suitable polymers include many of the common rubbers such as polyisobutylene, polyisoprene, polybutadiene, copolymers of styrene and butadiene and the like. Those rubbery polymers are all soluble in hydrocarbons generally and are soluble in a number of other common flammable solvents as well. When a rubber-based fire extinguishing composition is applied to the burning area of a flammable liquid, the rubbery polymer dissolves in the liquid and, as the concentration of polymer within the liquid increases, the viscosity of the liquid rapidly rises. Depending upon the amount of fire extinguishing composition applied, the liquid first displays a high degree of viscoelasticity which tends to hold the liquid mass together and allows its pickup and recovery after the fire has been extinguished using mechanical means. As the amount of polymer dissolved in the liquid increases, the liquid gels and at polymer concentrations on the order of one to ten percent, depending upon the molecular weight of the polymer and the characteristics of the liquid, forms a sticky, non-flowing semi-solid.

As individual polymer particles strike the surface of a flammable liquid and dissolve therein, the dry chemical agents carried on and around the particles separate therefrom. As has been recognized in the art, conventional formulations of dry chemical agents can rapidly extinguish the flames in burning flammable liquids but do not provide a lasting or securing effect against reignition. That lack of securing effect has been attributed to the fact that the powder is wetted by the liquid and, because it has a greater density than does the liquid, it immediately sinks. The sunken particles no longer can provide a flame extinguishing effect. Unlike the prior art, however, in the practice of this invention the dry chemical agent particles tend to be concentrated on the surface of the liquid as they separate from the polymer particle. As has been explained before, as polymer particles dissolve in the liquid, its viscosity rapidly increases. As liquid viscosity increases, the settling velocity of particles in the liquid markedly decreases. At relatively modest polymer concentrations, on the order of a few tenths of one percent or so, the liquid viscosity has increased sufficiently so that the settling velocity of small particles approaches zero. That circumstance insures that the exposed surface of the liquid carries a relatively high loading of dry chemical agent. Consequently, any tendency for reignition to occur at or adjacent to the exposed surface is suppressed by the presence of the chemical agent.

The heat resulting from combustion of a flammable liquid causes evaporation of the liquid with the resulting vapor feeding the fire. Heat and evaporation cause intense convective currents to form in the body of the burning liquid which continually exposes fresh liquid to the flame. In the practice of this invention, those convective currents within the burning liquid are slowed and finally stilled as the dissolving polymer progressively increases the liquid viscosity. Convection does, however, result in at least a portion of the dry chemical agent being distributed throughout the body of the liquid with the effect that the entire liquid mass becomes essentially non-flammable. A pool of jet fuel, for example, can be set afire and the fire extinguished by application of the fire extinguishing compositions of this invention to the fuel surface. A small amount of gasoline may then be poured atop the residual jet fuel and ignited. The gasoline will burn out without reigniting the jet fuel.

Dry chemical extinguishing agents appropriate for use in formulating the compositions of this invention include broadly all of those agents known and conventionally used in the art. Particularly preferred dry chemical agents include the alkali metal bicarbonates, potassium chloride, ammonium phosphates, particularly monoammonium phosphate, calcium phosphates, particularly tricalcium phosphate, the so-called carbamic powders which are addition products of urea with potassium bicarbonate, and the like. While a single extinguishing agent may be used to formulate the compositions of this invention in many instances important advantages can be obtained by using a combination of two or more different dry chemical agents. In addition to the polymer and the dry chemical extinguishing agents, minor amounts of lubricants, desiccants, fillers, surface modifying agents and the like may be advantageously incorporated into the inventive compositions to obtain desired flow characteristics and avoid caking during transport or storage. Included among those minor additives may be metal salts of fatty acids such as zinc and magnesium stearate, silicones, surfactants, particularly fluorocarbon surfactants, mica, bulking agents and fillers as are used with the traditional dry powder extinguishing formulations of the prior art.

As set out before, polymers useful in this invention comprise generally those thermoplastic polymers having a sufficiently high molecular weight to body or to gel hydrocarbon fuels or other flammable liquids when dissolved therein at relatively low concentration; on the order of a few tenths of one percent to a few percent by weight. A particularly useful group of polymers are the natural and synthetic rubbers having a molecular weight of about 2 million or greater. While lower molecular weight polymers can be used, the bodying or gelling efficiency of the polymers rapidly decreases as the molecular weight decreases. In all events, it is preferred that the polymer selected for use have a sufficiently high molecular weight to impart viscoelasticity to a solution of the polymer in the flammable liquid. Viscoelasticity is a property of a liquid which causes the liquid to display an elastic character when subjected to flow forces.

Manufacture of the compositions of this invention requires that the selected polymer be shredded, ground, or otherwise comminuted into relatively small discrete particles and a coating comprising one or more dry chemical extinguishing agents be arranged in intimate association with and around those discrete polymer particles. Size of the polymer particles is not critical but should generally be small enough to pass a 40 mesh screen. The amount of dry chemical extinguishing agent coating or surrounding an individual particle must be sufficient to protect the polymer particle from decomposition and combustion as it passes through the heat and flame zone of a fire. Ordinarily, the polymer moiety of the particles of the compositions of this invention will range broadly from about 5% to about 40% by weight and in most instances will range from about 10% to about 30% by weight. If the polymer particles do not have a sufficient amount of dry chemical extinguishing agent protecting them, the polymer particles will be ignited as they pass through the flame thus adding to the fire rather than aiding in its extinction.

The bicarbonates of sodium and potassium are among the most preferred dry chemical agents for protecting the polymer particles. Sodium bicarbonate starts to decompose and generate carbon dioxide at a temperature of less than 300 degrees C which is a temperature at which most rubbery polymers are still relatively stable. Potassium bicarbonate starts to generate carbon dioxide at even lower temperatures. The carbon dioxide produced by decomposition of the bicarbonates tends to at least temporarily shield the polymer core from the combustion atmosphere. It has been found to be advantageous in many instances to provide multiple layers of different dry chemical agents around the core polymer particle. For example, particularly effective compositions include a high molecular weight particle of a rubber such as polyisobutylene as the core with an initial coating of tricalcium phosphate. Atop the tricalcium phosphate coating may be placed a layer of sodium bicarbonate, then a layer of monoammonium phosphate, and finally a second layer of sodium bicarbonate. The weight of the dry chemical agents preferably amounts to some two-thirds to three quarters of the total composition weight. A small amount of calcium stearate or other flow enhancing agent may be applied to the outer sodium bicarbonate layer to improve the flow characteristics of the powder and to decrease its tendency to bridge when used as the charge in a gas-pressured fire extinguisher.

It is convenient to grind or comminute most polymers while also applying a coating of the first dry chemical extinguishing agent by use of the process described by O'Mara et al in their U.S. Pat. No. 4,720,397. That patent describes a cryogenic grinding method for the preparation of rapid dissolving and free-flowing polymer compositions. A polymer is chilled below its glass transition temperature and is then comminuted in an inert atmosphere such as nitrogen to obtain small particles. Those polymer particles are then mixed with a very finely powdered coating agent while raising the temperature of the mixture to and above the glass transition temperature of the polymer. As a result, there is obtained polymer particles having a tightly adhering coating or shell of the coating agent thereabout. That coating can be built up in thickness or a coating of another finely divided solid can be applied on top of the first one through use of conventional coating techniques. For example, the coated polymer particles can be tumbled in a cone blender or similar device along with a quantity of finely powdered dry chemical agent which may be the same as or different from the first coating. A small amount of water or other binding liquid may be added in the form of a mist to cause the powdered agent to build up on the surfaces of the polymer-containing particles.

While grinding and coating of the polymer particles has been described in relation to the process set out in U.S. Pat. No. 4,720,397, preparation of the compositions of this invention do not require use of that technique. Other means of forming small polymer particles and associating dry chemical extinguishing agents therewith may be used as well. For example, the polymers may be mulled with one or more of the dry chemical fire extinguishing agents and the mulled mixture may then be shredded into small particles. Those particles may then be coated with additional or different dry chemical agents in conventional fashion.

The fire extinguishing compositions of this invention may also be applied to a fire as a foam. That method of application provides advantages over the use of powder in certain instances. Whether applied as a powder or as a foam, the compositions of this invention must have in common a protective coating or shell of fire extinguishing material around or otherwise intimately associated with the individual polymer particles. Application of the compositions as a foam may be accomplished by preparing a dry powder formulation as described earlier with the provision of means to mix or merge the powder with a foaming liquid and to generate or otherwise provide pressurized gas to both cause foaming and to propel the composition to the burning surface. Gas generation may be accomplished in known fashion by selection of the dry chemical fire extinguishing agents associated with the polymer particles so that addition of water to the formulation will cause decomposition of one or more of the agents and release carbon dioxide or other gas. For example, compositions which include an alkali metal bicarbonate and an acidic extinguishing agent such as monoammonium phosphate will react when contacted with water to generate carbon dioxide. If water is added to the composition within a closed container, sufficient pressure is developed within the container to propel the resulting slurry out of the container and onto a burning surface. An equivalent effect can be obtained without use of an acidic extinguishing agent by incorporating an acid within the water added to the composition. Alternatively, a gas such as carbon dioxide or nitrogen from an external source can be used to foam and to propel the fire extinguishing compositions onto a burning surface.

When the compositions of this invention are applied to a fire as a slurry or foam, it is often desirable to incorporate various foaming agents within the formulation used. For example, a film-forming synthetic surfactant, especially one of the fluorosurfactants such as those known as "AFFF" compositions, may be mixed with the water added to the fire extinguishing composition. Also useful are those foamable compositions based on an aqueous mixture of a fluorosurfactant and a hydrolyzed protein. Concentrations of the surfactant or other foamable composition in the water ranging from about 2% to about 10% are ordinarily appropriate.

Specific examples of the invention are set out below. These examples are intended to provide a clear understanding of the invention, are merely illustrative, and are not to be understood as limiting the principles and scope of the invention.

EXAMPLE 1

A quantity of polyisobutylene having a molecular weight of about 6 million was chilled with liquid nitrogen and was comminuted in the manner set out in U.S. Pat. No. 4,720,397. The resulting polymer particles were contacted with finely powdered tricalcium phosphate (TCP) while the polymer warmed to thereby form an adherent coating around the polymer particles. The tricalcium phosphate used had a median particle size of less than one micrometer and the coating amounted to about 35% by weight of the resulting composition. About 20% by weight of powdered monoammonium phosphate was then applied to the TCP-coated particles by tumbling the mixture while adding a small quantity of water as a mist to bind the coating. The resulting composition was then coated with about 20% by weight of sodium bicarbonate in similar fashion. A small amount of calcium stearate was then added to the composition with additional mixing to enhance the flow characteristics of the powder.

EXAMPLE 2

A quantity of gasoline was poured onto the surface of water contained in a flat pan. The gasoline, which floated on top of the water, was ignited and allowed to burn for a short while. A quantity of the powder composition described in Example 1 amounting to about 20% by weight of the gasoline was applied to the fire. The fire was immediately extinguished. Residual gasoline had been gelled and could be lifted as a mass from the water. An open flame played across the surface of the gelled gasoline would not reignite it. A small amount of fresh gasoline was then poured onto the gelled residue and ignited. The fresh gasoline burned out without reigniting the residue.

EXAMPLE 3

Cooking oil was set afire and, after the fire had become well established, a small amount of the composition of Example 1 was applied to the fire. The fire was immediately extinguished. An examination of the fire residue showed that a tough film had been formed across the surface of the oil and that film could not be reignited by playing an open flame across it. It is to be noted that polyisobutylene is either insoluble or sparingly soluble in cooking oils.

EXAMPLE 4

A portion of the composition of Example 1 was placed into a hand fire extinguisher and water containing 6% by weight of AFFF foam agent was then added and the extinguisher was sealed. The extinguisher was then shaken to mix the liquid and powder which resulted in an immediate build-up of pressure within the extinguisher. The extinguisher was discharged upon a fire of burning jet fuel floating on water and the fire was immediately extinguished. The residual jet fuel was highly viscoelastic and could be moved around on the water surface as a coherent mass. It could not be reignited by playing an open flame across its surface.

As can be appreciated, the compositions of this invention will be applied to the burning surface in the conventional ways utilized to apply dry powders and foams. Ordinarily, the application of an amount of extinguishing agent sufficient to put out the fire will also be enough to gel and to render non-flammable any residual liquid fuel. However application of an additional amount of extinguishing agent, either powder or foam, may be advantageous to prevent flow or migration of liquid fuels. Further, both the powder and foam compositions of this invention will find use in preventing the spread of fire to other sources of fuel. In this mode, the fire extinguishing compositions may be applied to exposed fuel surfaces such as flammable liquids contained in tanks or the like. The resulting gelling of the liquid surface and concentration of dry chemical extinguishing agents thereat will substantially reduce the risk of ignition.

I claim:

1. A composition for extinguishing fires comprising a particulate combustible high molecular weight thermoplastic polymer, the particles of said polymer arranged in intimate association with a sufficient quantity of a chemical extinguishing agent to protect said polymer particles during transit through a flame and onto the surface of a burning substance; said chemical extinguishing agent selected from the group consisting of alkali metal bicarbonates, alkali metal halides, alkaline earth metal carbonates, ammonium phosphates, addition products of urea with alkali metal bicarbonates and mixtures thereof.

2. The composition of claim 1 wherein said thermoplastic polymer makes up from about 5% to about 40% by weight of said composition.

3. The composition of claim 2 wherein the thermoplastic polymer is soluble in liquid hydrocarbons.

4. The composition of claim 3 wherein the molecular weight of said polymer is in excess of 2 million.

5. The composition of claim 1 wherein the particles of said composition are coated with a surface modifying agent.

6. The composition of claim 5 wherein said surface modifying agent is selected from the group consisting of metal salts of fatty acids, silicones, and surfactants.

7. The composition of claim 1 wherein said chemical extinguishing agent includes a foamable material selected from the group consisting of film forming synthetic surfactants and hydrolyzed proteins.

8. A method of extinguishing a fire of a flammable substance which comprises applying to the burning area of said substance a fire extinguishing composition comprising a particulate combustible high molecular weight thermoplastic polymer, the particles of said polymer arranged in intimate association with a sufficient quantity of a chemical extinguishing agent to protect said polymer particles during transit through a flame and onto the surface of said burning substance.

9. The method of claim 8 wherein said substance is a flammable liquid and wherein said thermoplastic polymer moiety of said fire extinguishing composition is soluble in said flammable liquid.

10. The method of claim 9 wherein said flammable liquid comprises a hydrocarbon and wherein said thermoplastic polymer moiety comprise a rubber having a molecular weight in excess of 2 million.

11. A method for extinguishing a fire of a flammable liquid and preventing its reignition which comprises applying particles of a thermoplastic polymer to the burning area of said liquid, said polymer being soluble in said liquid, said polymer particles having associated therewith one or more chemical fire extinguishing agents arranged to protect the polymer particles during transit through a flame to said burning area.

12. The method of claim 11 wherein said chemical fire extinguishing agents are selected from the group consisting of alkali metal bicarbonates, alkali metal halides, alkaline earth metal carbonates, ammonium phosphates, and addition products of urea with alkali metal bicarbonates.

13. The method of claim 11 wherein said chemical fire extinguishing agents include a foamable composition selected from the group consisting of film forming synthetic surfactants and hydrolyzed proteins.

14. A method for making a flammable liquid resistant to burning which comprises adding to said liquid particles of a high molecular weight polymer together with a powdered dry chemical fire extinguishing agent, the molecular weight of said polymer sufficient to gel said flammable liquid upon dissolving therein and the concentration of dry chemical extinguishing agent in said liquid at an exposed surface thereof being sufficient to quench flame.

15. The method of claim 14 wherein said liquid is a hydrocarbon and said polymer is a rubber.

16. A composition for extinguishing fires comprising a particulate combustible high molecular weight thermoplastic polymer, the particles of said polymer coated with multiple layers of at least two different chemical extinguishing agents, a first chemical extinguishing agent forming a first layer around the polymer particles and a second chemical extinguishing agent forming a second layer about said first layer, the quantity of said chemical extinguishing agents making up the multiple layers being sufficient to protect said polymer particles during transit through a flame and onto the surface of a burning substance.

17. A product produced by the method of claim 14.

* * * * *